United States Patent [19]

Kuckenbecker

[11] 4,144,996

[45] Mar. 20, 1979

[54] HINGED CARTON

[75] Inventor: Morris W. Kuckenbecker, Neenah, Wis.

[73] Assignee: American Can Company, Greenwich, Conn.

[21] Appl. No.: 750,396

[22] Filed: Dec. 14, 1976

[51] Int. Cl.[2] ..... B65D 5/22

[52] U.S. Cl. ..... 229/33; 229/44 R

[58] Field of Search ..... 229/33, 36, 44 R

[56] References Cited

U.S. PATENT DOCUMENTS

| | | | |
|---|---|---|---|
| 1,667,976 | 5/1928 | Labombarde | 229/33 |
| 2,094,448 | 9/1937 | Evans | 229/33 |
| 2,691,480 | 10/1954 | Boeye et al. | 229/14 |
| 3,433,402 | 3/1969 | Persson | 229/33 |
| 3,645,382 | 2/1972 | Abrams | 229/33 |
| 3,693,865 | 9/1972 | Desmond et al. | 229/33 |
| 4,050,624 | 9/1977 | Williams | 229/44 R X |

FOREIGN PATENT DOCUMENTS

| | | | |
|---|---|---|---|
| 665835 | 7/1964 | Italy | 229/33 |
| 930495 | 7/1963 | United Kingdom | 229/44 R |

*Primary Examiner*—William Price
*Assistant Examiner*—Joseph M. Moy
*Attorney, Agent, or Firm*—Robert P. Auber; Ira S. Dorman; Harry C. Engstrom

[57] ABSTRACT

A carton formed from a unitary paperboard blank and having a reclosable cover portion hingedly nestable over a receptacle portion. Both the cover and receptacle portions have double board thickness full-height sidewalls and may have double thickness top and bottom panels to provide good stacking and crushing strength. At least a portion of the inner surfaces of the carton are the same surface of the flat paperboard blank that forms the outside surfaces of the carton so that printing may be obtained on both the inside and outside of the carton by printing only on one surface of the flat blank.

2 Claims, 9 Drawing Figures

HINGED CARTON

BACKGROUND OF THE INVENTION

This invention relates to reclosable hinged cover cartons formed from a unitary paperboard blank. While, of course reclosable cartons of many types are known, none of the type combining the particular construction of full-height double thickness sidewalls and the one sided printing advantages disclosed herein is known in the art.

SUMMARY OF THE INVENTION

The carton has double panel sidewalls and the top and the bottom may also be double thickness, or various combinations thereof may be achieved depending on the type of product to be packaged, the stacking and crushing strength required, and the amount of printing desired on the inside surfaces of the carton in addition to the usual printing on the outside.

At least a portion of the inner surfaces of the carton are provided by the same surface of the paperboard blank forming the outside surfaces of the carton so that printing may be obtained on both the inside and outside of the carton by prining on only one surface of the flat paperboard blank on a single pass through the printing press.

Basically, the carton has a bottom panel and front, rear and pair of sidewalls forming a receptacle portion; a top panel and front, rear and pair of sidewalls forming a cover portion; and a rear hinge panel hingedly connected to the receptacle portion of the carton at the rear edge of the bottom panel and connected to the cover portion of the carton at the rear edge of the top panel. The hinge panel may be adhered to the rear wall of the cover portion depending on the style of carton desired.

Further objects, features and advantages of the invention will be apparent from the following detailed description taken in conjunction with the accompanying drawings showing preferred embodiments of the invention for exemplification.

DESCRIPTION OF PREFERRED EMBODIMENTS

Figure 1:
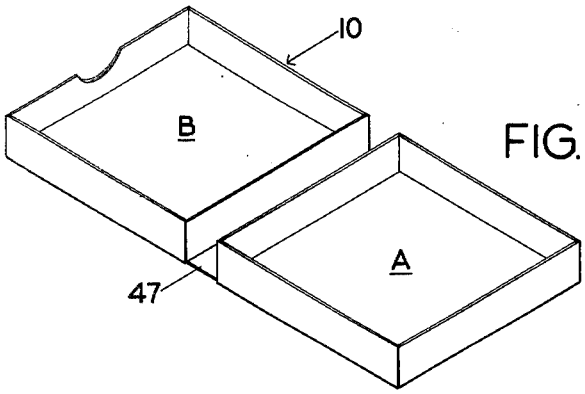
FIG. 1 is an isometric view of a carton in full open position embodying the principles of this invention.
Figure 2:
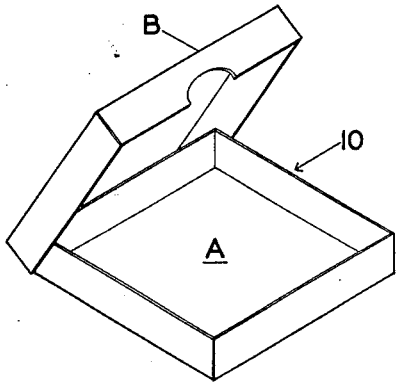
FIG. 2 is an isometric view of the carton of FIG. 1 with the cover portion partially open.

Referring more particularly to the drawings wherein like numerals refer to similar parts throughout the several views, the carton 10 as shown in FIGS. 1 and 2 has a receptacle portion A and a cover portion B hingedly connected by a rear hinge panel 47. Depending on the carton style desired, the carton 10 may also be made in the form shown in FIG. 3 by merely adhering the hinge panel 47 to the rear side of the cover portion. The carton style shown in FIG. 3 would, of course, be opened and closed in the same manner as the style shown in FIG. 2.

Figure 3:
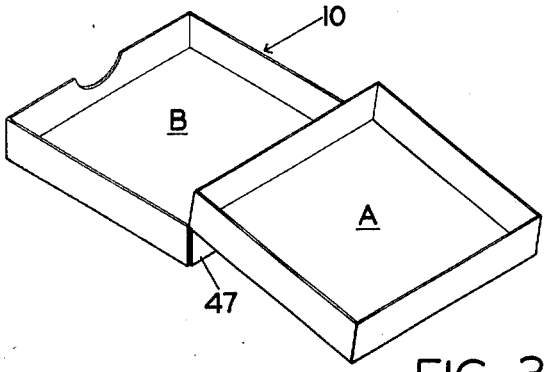
FIG. 3 is an isometric view of a second form of the carton of FIG. 1 in full open position.

The basic carton forms generally shown in FIGS. 1 and 3 may be constructed from any of the three paperboard blank embodiments shown in FIGS. 4–9 depending on the requirements of the package.

Figure 4:
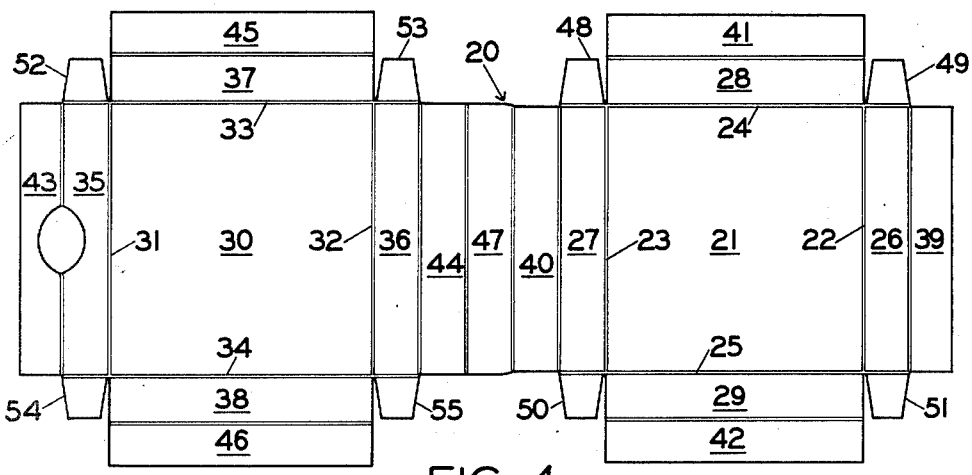
FIG. 4 is a plan view of a paperboard blank for forming the carton of this invention.
Figure 5:
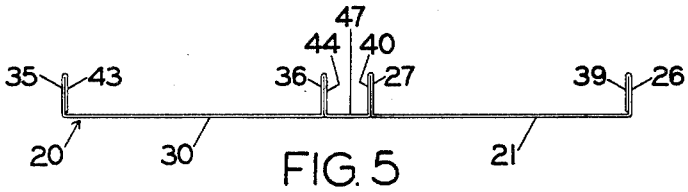
FIG. 5 is a side elevation view of the paperboard blank shown in FIG. 4 partially set up.

Referring first to FIGS. 4 and 5, the paperboard blank 20 shown therein has a bottom panel 21 having front, rear and a pair of side edges, 22–25, respectively, formed by scoring the blank in the well known manner. The blank has a front receptacle wall 26, rear receptacle wall 27 and a pair of side receptacle walls 28 and 29 hingedly connected to the bottom panel 21 along the front, rear and side edges 22–25 respectively. The blank has a top panel 30 which is slightly larger than the bottom panel to facilitate nesting of the cover portion over the receptacle portion. The top panel 30 has front, rear, and a pair of side edges 31–34, respectively, formed by appropriate scoring. A front cover wall 35, rear cover wall 36 and pair of side cover walls 37 and 38 are hingedly connected to the top panel 30 along the front, rear and pair of side edges 31–34, respectively. A front receptacle flap 39 is hingedly connected along a score line to the front receptacle wall 26 opposite the bottom panel and a rear receptacle flap 40 is hingedly connected along a score line to the rear receptacle wall 27 opposite the bottom panel. A pair of side receptacle flaps 41 and 42 are hingedly connected along score lines to the side receptacle walls 28 and 29, respectively. A front cover flap 43 is hingedly connected along a score line to the front cover wall 35 opposite the top panel and a rear cover flap 44 is hingedly connected along a score line to the rear cover wall 36 opposite the top panel. A pair of side cover flaps 45 and 46 are hingedly connected along score lines to the side cover walls 37 and 38, respectively. A rear hinge panel 47 is hingedly connected along opposed edges formed by score lines to rear receptacle flap 40 and rear cover flap 44. Lastly, four receptacle corner tabs 48–51 are provided for joining the four receptacle walls and the four receptacle flaps together to form a continuous double thickness sidewall of the receptacle portion of the carton and four cover corner tabs 52–55 are provided for joining the four cover walls and the four cover flaps together to form a continuous double thickness sidewall of the cover portion of the carton.

The paperboard blank 20 as described above may be set up to form either of the basic carton styles shown in FIGS. 1 and 3 depending on whether the rear hinge panel 47 is or is not adhered to the rear cover flap 44.

Blank 20 provides a carton in which each of the vertical walls of both the receptacle portion A and the cover portion B are double walled. When closed, the carton formed by this blank has four-ply vertical sidewalls except for the rear sidewall which is five-ply to provide a carton with excellent stacking and crushing strength. This blank construction produces a carton on which printing may be provided on the inside of three vertical sidewalls of both the cover and receptacle portions by merely printing on just the outside surface of the flat paperboard blank with a single pass through the printing press.

Figure 6:
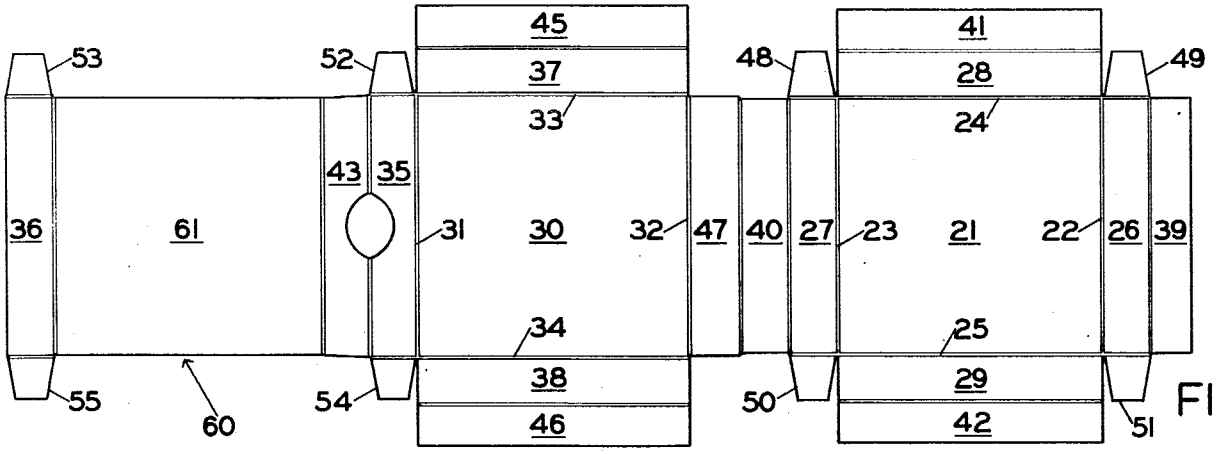
FIG. 6 is a plan view of a modified form of the paperboard blank of FIG. 3 for constructing the carton of this invention.
Figure 7:
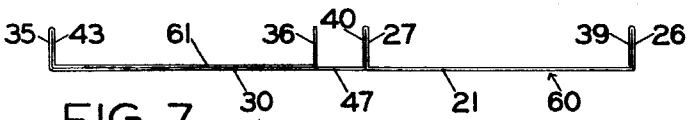
FIG. 7 is a side elevation view of the modified form of the paperboard blank of FIG. 6 partially set up.

Referring to FIGS. 6 and 7, the paperboard blank embodiment 60 shown therein is similar to blank 20 except that rear cover flap 44 of blank 20 is eliminated and rear cover wall 36 (together with its corner tabs 53 and 55) instead of being between the top and bottom panels is hingedly connected along a score line to an inner top flap 61 which in turn is hingedly connected along a score line to front cover flap 43 opposite the front cover wall 35. As shown in FIG. 7, when front cover wall and flap, 35 and 43, are set up, inner top flap 61 is folded over to extend across the top panel 30 and upstanding wall 36 forms the rear side of the cover portion of the carton.

Paperboard blank 60 as described above may be set up in either of the basic carton forms shown in FIGS. 1 and 3 depending on whether rear hinge panel 47 is or is not adhered to the rear cover wall 36.

Blank form 60 produces a carton in which the addition of inner top flap 61 provides a double board thickness top for the cover portion B. When closed, the carton formed by blank 60 has four-ply sides. Furthermore, this construction produces a carton on which printing may be provided on all the inside surfaces of the cover portion in addition to the usual printing on the outside with just single-pass, one-sided printing of the flat blank because all of the exposed inside and outside surfaces of the cover portion of the carton are formed from the outside surface of the flat blank.

Figure 9:
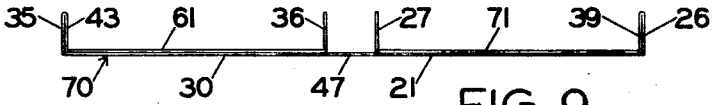
FIG. 9 is a side elevation of the modified paperboard blank of FIG. 8 partially set up.
Figure 8:
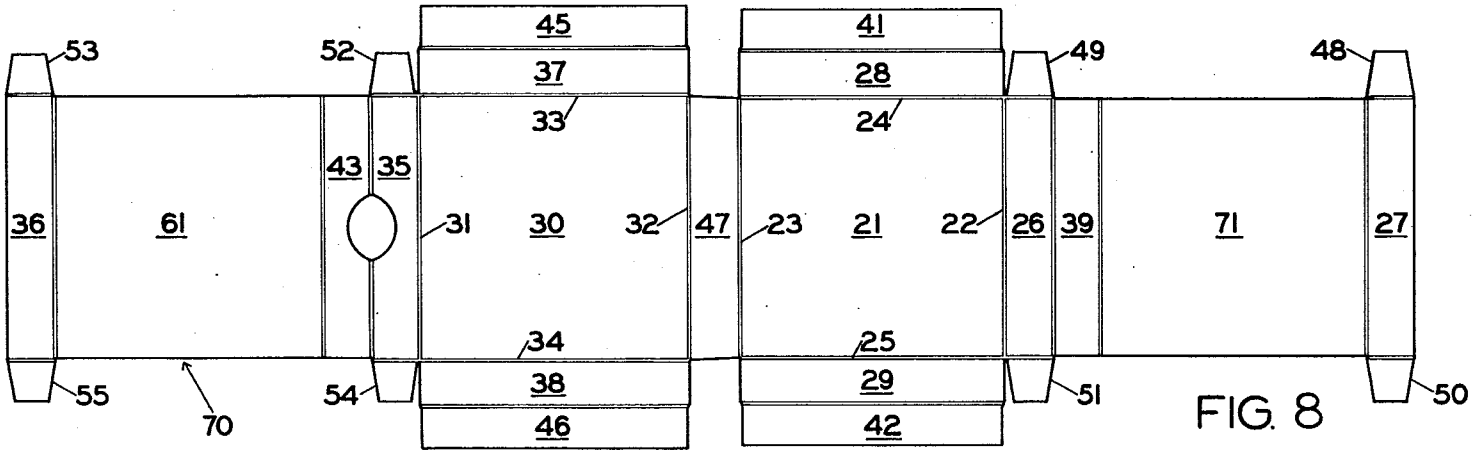
FIG. 8 is a plan view of an additional modification of paperboard blank for forming the carton of this invention.

Referring to FIGS. 8 and 9, the paperboard blank embodiment 70 shown therein is similar to blank 60 except that the rear receptacle flap 40 of blank 60 is eliminated and rear receptacle wall 27 (together with its receptacle corner tabs 48 and 50) instead of being between the top and bottompanels is hingedly connected along a score line to an inner bottom flap 71 which in turn is hingedly connected along a score line to front receptacle flap 39 opposite the front receptacle wall 26. This leaves just the rear hinge panel 47 between bottom panel 21 and top panel 30. As shown in FIG. 9, when the front receptacle wall and flap, 26 and 39, are set up, inner bottom flap 71 is folded over to extend across bottom panel 21 and upstanding wall 27 forms the rear of the receptacle portion of the carton.

Paperboard blank 70 as described above may be set up in either of the basic carton forms shown in FIGS. 1 and 3 depending on whether rear hinge panel 47 is or is not adhered to the rear cover wall 36.

Blank form 70 produces a carton in which the addition of inner bottom flap 71 provides a double board thickness bottom for the receptacle portion A; as well as having inner top flap 61 which does the same for the top of the cover portion B as previously described in connection with blank 60 above. Furthermore, this construction produces a carton on which printing may be provided on all the inside surfaces of the entire carton in addition to the usual printing on the outside surfaces with just single-pass, one-sided printing of the flat blank because all of the exposed inside and outside surfaces of the carton are formed from the outside surface of the flat blank.

It should be understood that this invention is not limited to the particular construction and arrangement of parts herein illustrated and described, but embodies all such modified forms as come within the scope of the following claims.

I claim:

1. A unitary carton blank for forming a carton having a reclosable cover portion hingedly nestable over a receptacle portion, said blank comprising:

(a) a bottom panel having a front edge, rear edge, and pair of side edges;

(b) a front receptacle wall, rear receptacle wall, and a pair of side receptacle walls hingedly connected to said bottom panel along the front, rear, and side edges respectively of said bottom panel to thereby allow said receptable walls to be folded at their hinged connections to form sidewalls for the receptacle portion of the carton;

(c) a top panel having a front edge, rear edge, and a pair of side edges;

(d) a front cover wall, rear cover wall, and a pair of side cover walls hingedly connected to said top panel along the front, rear, and side edges respectively of said top panel to thereby allow said cover walls to be folded at their hinged connections to form sidewalls for the cover portion of the carton;

(e) a front receptacle flap hingedly connected to said front receptacle wall opposite said bottom panel to thereby allow said front receptacle flap to be folded toward said front receptacle wall to form a double thickness sidewall;

(f) a front cover flap hingedly connected to said front cover wall opposite said top panel to thereby allow said front cover flap to be folded toward said front cover wall to form a double thickness sidewall;

(g) a rear receptacle flap hingedly connected to said rear receptacle wall opposite said bottom panel to thereby allow said rear receptacle flap to be folded toward said rear receptacle wall to form a double thickness sidewall;

(h) a rear cover flap hingedly connected to said rear cover wall opposite said top panel to thereby allow said rear cover flap to be folded toward said rear cover wall to form a double thickness sidewall; and (i) a rear hinge panel hingedly connected along opposed edges to said rear receptacle flap and said rear cover flap whereby the cover portion of the carton can be opened and closed about said hinged connections between said rear hinge panel and said rear receptacle flap and rear cover flap.

2. A carton blank as specified in claim 1 comprising: a pair of side receptacle flaps hingedly connected to said side receptacle walls; a pair of side cover flaps hingedly connected to said side cover walls; four receptacle corner tabs for joining said four receptacle walls and said four receptacle flaps together to form a continuous double thickness sidewall of said receptacle portion; and four cover corner tabs for joining said four cover walls and said four cover flaps together to form a continuous double thickness sidewall of said cover portion.

* * * * *